US005162180A

United States Patent [19]

Leenders et al.

[11] Patent Number: 5,162,180

[45] Date of Patent: Nov. 10, 1992

[54] XEROPRINTING PROCESS USING REVERSAL DEVELOPMENT PROCESS

[75] Inventors: Luc H. Leenders, Herentals; Robert C. Van Haute, Geel; Eddy A. Michiels, Kontich; Serge M. Tavernier, Lint; Robert F. Janssens, Geel; André Verhecken, Mortsel, all of Belgium

[73] Assignee: AGFA-Gevaert, N.V., Mortsel, Belgium

[21] Appl. No.: 599,419

[22] Filed: Oct. 18, 1990

[30] Foreign Application Priority Data

Oct. 23, 1989 [EP] European Pat. Off. ..... 89202664.2

[51] Int. Cl.[5] ..... G03G 5/026

[52] U.S. Cl. ..... 430/49; 430/100; 430/67

[58] Field of Search ..... 430/49, 100, 66, 67

[56] References Cited

U.S. PATENT DOCUMENTS 4,859,551 8/1989 Kempf ..... 430/49

4,859,557 8/1989 Detig et al. ..... 430/100

*Primary Examiner*—John Goodrow

*Attorney, Agent, or Firm*—Breiner & Breiner

[57] ABSTRACT

The present invention relates to a xeroprinting process, in particular a xeroprinting process comprising the following steps:

(a) image-wise exposing to actinic radiation an electrostatic master having a photopolymerizable conductive layer to selectively polymerize and thereby increase resistivity in exposed areas of the layer;

(b) forming a latent image of electrostatic charge by charging the master by corona discharge;

(c) reversal developing the latent electrostatic image by depositing toner particles in the non-exposed areas of the layer;

(d) transferring the toner image to another substrate and subsequent fusing;

(e) resetting the process by cleaning and discharging the electrostatic master.

According to a preferred embodiment the reversal development is effected by means of a development electrode inducing charges in the photopolymer plate opposite to the initial electrostatic image, and by means of dry electrophotographic toner.

10 Claims, No Drawings

XEROPRINTING PROCESS USING REVERSAL DEVELOPMENT PROCESS

FIELD OF THE INVENTION

The present invention relates to a xeroprinting process, wherein the latent electrostatic image formed on a master substrate is developed by the reversal process, i.e. a process whereby toner particles are deposited on the non-charged areas of the electrostatic master.

BACKGROUND ART

In the article entitled "Electrostatic Image Formation by using Photopolymerizable Monomers" from E. Inoue and H. Fukutomi, published in the Journal of the Society for Photographic Science and Technics, Japan, 41 (1978) No. 5, pages 333 to 340, a xeroprinting process is described wherein electrostatic printing masterplates which are based on photopolymerizable compositions are employed.

According to this process a masterplate comprising a photopolymerizable composition coated on a grounded conductive substrate is first image-wise exposed to actinic radiation, is subsequently charged to produce a latent image of electrostatic charge, said latent image is thereupon developed by toning, and the toner image is finally transferred by electrostatic or other means to another substrate.

When using the photopolymerizable compositions disclosed in said publication, a remarkable difference in corona charge acceptance between the unexposed area and the exposed one was noted, the latter being caused by a remarkable decrease in conductivity in the exposed and hence polymerized areas.

The xeroprinting process can be used for a large number of applications such as making color proofs, reproduction of documents and the printing of integrated circuit boards. As the image formed in the photopolymerizable master plate is persistent, the process can also be employed for short run printing by repeating the charging, toning and transfer steps.

FIG. 19 of the aforementioned publication shows multiple copies (original, 50th, 300th and 1000th) from a single exposure by repetition of the charging, dusting and electrostatic powder transfer steps. Further details about the xeroprinting process based on photopolymerizable master plates are disclosed in EU-A-0243934.

The xeroprinting process differs from the traditional xerocopying process above all in this respect that in the case of xerocopying the image formed on the photoconductive drum is not persistent. This implies that for the reproduction of multiple copies of the same original, the entire process of overall corona charging, image-wise illumination of the charged photoconductive drum followed by toning, transfer of the toned image and again overall corona charging is applied for each copy produced. The substantial advantage of the xerocopying process resides in the fact that the same photoconductive drum, as opposite to an electrostatic masterplate, can be used for reproducing a very large number of different originals. Particular aspects of the xerographic process are set forth in R. M. Schaffert "Electrophotography", The Focal Press, London, New York, enlarged and revised edition, 1975, as well as in numerous patent applications.

With respect to the development of the latent image formed on the photoconductive drum of a xerocopying apparatus, two operating modes can be used.

When developing an electrostatic image to form a positive reproduction of an original, the carrier particle composition and/or toner particle composition is selected so that the toner particles acquire a charge having a polarity opposite to that of the electrostatic latent image so that toner deposition occurs in the non-exposed areas of the photoconductive drum. Alternatively, in reversal reproduction of an original, the carrier particle composition and toner particle composition is selected so that the toner particles acquire a charge having the same polarity as that of the electrostatic latent image resulting in toner deposition in the exposed areas of the photoconductive drum.

The above tow modes are disclosed e.g. in EU-A-0279960, dealing with a particular toner composition for use in a xerographic reproduction process.

AU-B-250672 discloses a typical xerocopying image-producing process comprising exposing to a light- or other radiation image a photoconductive material the conductivity of which is selectively increased by the radiation and which is capable of retaining the resultant latent image for a period of time in the dark. On account of the particular composition of the photoconductive material disclosed therein, the conductive latent image will persist in the dark within the electrophotographic material for a relatively long period of time. In respect of the development process of the electrophotographic process disclosed therein, on page 11, six lines on top of said page, it is disclosed that by suitable choice of the sign of the charge of the developing powder a negative or positive print can be obtained at will from any original.

However, said specification relates to a xerocopying process whereby, as set forth in the middle of page 10 of said patent specification, in the irradiated areas of the photoconductive layer or sheet, a remanent increase of the conductivity is obtained. In the xeroprinting process of our invention, in the irradiated areas of the xeroprinting master, a remanent decrease of the conductivity is obtained.

GB-A-1085573 discloses also a particular embodiment of an electrophotographic process whereby on page 7, lines 29–36, the production of a photographic reversal image is described by applying the reversal development process. However, this specification is also directed to the application of the xerocopying process.

Now, with respect to the xeroprinting process as described in the publication from E. Inoue and H. Fukutomi, only the use of the positive development mode has been described. In said description an example has been cited whereby the master plate has been charged with a corona wire with a charging potential of −6 kV for a period of about 1 second, and the toning of the plate has been effected by the magnetic brush system employing a double component developer comprising a Fe-carrier and a positively charged toner. So in this example the charge of the toner is opposite to the charge applied by the corona transfer, which implies that the (negative) charge retaining areas are developed by attracting the oppositely (positively) charged toner particles, i.e. positive development mode.

Also in EU-A-0243934 only the positive development mode has been disclosed for developing the latent images on the electrostatic masterplate.

In the xeroprinting process as described in said application, the exposed (polymerized) areas accept by corona discharge or by another charging mechanism a high initial charge and retain a significant portion of that charge long enough to permit toning, whereas the charge in the unexposed areas decays rapidly to substantially zero. Ideally, at the time of contact with the toner, the voltage in exposed areas should be at least 10 V, preferably at least 100 V, more than that of the voltage in unexposed areas, and best results are obtained when the voltage in the unexposed areas has decayed to near zero or zero.

In the examples set forth in said application the masterplate was charged positively using a single wire corona set at 7.2 kV. Immediately after charging, the masterplate was developed by dipping into a dispersion of negatively charged toner.

In the experiments set forth under Example 7 the opposite type of positive development was applied: the photopolymer surface was charged with a negative corona and developed by applying positively charged toners.

One of the characteristics of the conventional electrophotographic process is that—in case the usual positive development mode is used—it is a direct positive process, this means positive reproductions are made from a positive original. The technical cause hereof is that the electrostatic charge is retained in the non-exposed areas—corresponding to the image areas—of the photoconductive surface.

One of the characteristics of the xeroprinting process is that—in case the usual positive development mode is used, as in all the prior art cited hereinbefore,—it is on the contrary a reversal process, implying that negative reproductions are made from a positive original. The technical cause hereof is that the electrostatic charge is retained in the polymerized, i.e. exposed areas of the xeroprinting plate corresponding to the non-image areas of the original.

The latter characteristic entails much inconvenience in some applications of xeroprinting, in particular in proofing applications.

In the graphic arts field, in particular in analog and digital color proofing applications, wherein electrostatic masters based on photohardenable layers coated on a conductive support have a promising future, some proofers work with negative color separations whereas other work with positive color separations. As a result thereof there is a need for xeroprinting processes capable of producing negative, resp. positive images.

Now as is set forth above, the xeroprinting process in se yields negative images. Therefore special efforts have to be performed to device a xeroprinting process yielding positive images. In EP 0 315 121 a xeroprinting process for producing negative or positive images from a photohardenable electrostatic master has been disclosed. However, according to the cited reference the production of positive images by the xeroprinting process requires the use of an unusual photohardenable layer according to a particulate chemical composition and further requires an additional illumination step to take place. The master should be first imagewise exposed to ultraviolet radiation, and thereafter overall exposed to visible radiation. However, the development proceeds by a pos-pos development, i.e. deposition of toner on oppositely charged image areas.

It is now an object of the present invention to design the xeroprinting process in such a way that when using conventional photohardenable layers and a one-step imagewise illumination, positive reproductions of an original can be accomplished.

SUMMARY OF THE INVENTION

Therefore, we now have developed a xeroprinting process yielding positive reproductions of an original, and which comprises the following steps:

(a) image-wise exposing to actinic radiation an electrostatic master having a photopolymerizable conductive layer to selectively polymerize and thereby increase resistivity in exposed areas of the layer;

(b) forming a latent image of electrostatic charge by charging the master by corona discharge;

(c) reversal developing the latent electrostatic image by depositing toner particles in the non-exposed areas of the layer;

(d) transferring the toner image to another substrate and subsequent fusing;

(e) resetting the process by cleaning and discharging the electrostatic master.

According to a preferred embodiment of the present invention, the reversal development of the electrostatic latent image is effected by means of a development electrode thereby inducing charges in the photopolymer plate opposite to the initial electrostatic image.

The development of the electrostatic latent image may be effected by either a dry or a liquid electrophotographic developer. According to a preferred embodiment dry development is used.

According to a further preferred embodiment of the present invention the photopolymerizable conductive layer comprises the compounds set forth hereinafter.

One of the advantages resulting from our invention is an increase in transfer efficiency of the toned image on the master plate to the final substrate, in comparison with the transfer efficiency of the xeroprinting process using the positive development mode. Indeed, when applying the positive development mode, toner particles are attached to the master plate by the joint effort of adhesive forces on the one hand and strong electric attraction on the other hand (e.g. in case of a positively charged toner, the master plate may be negatively charged up to −500 or −700 V). This often results in poor transfer efficiency when the commonly used bias technique is employed. When on the contrary the reversal development mode according to our invention is applied, the toner particles are attached to the master plate by conventional adhesive forces and only moderate electrical attraction forces (resulting from attraction of the toner particles by induced electric charges, in case a development electrode is employed). This results in higher transfer efficiency. The latter advantage is particularly relevant when master plates are used as latent image carrying means, as in the case of xeroprinting. The possibility to enhance the poor transfer efficiency of the positive development mode by application of the so-called pre-transfer exposure technique, as described in U.S. Pat. No. 4,233,381, is in fact only applicable when a conventional photoconductive drum is employed; this method cannot be applied when a master plate—as in xeroprinting—is employed.

DETAILED DESCRIPTION OF THE INVENTION

Exposure

Illumination of the xeroprinting plate may be effected by either analog or digital means. In case of analog exposure, a line or half-tone negative or pattern is interposed between the source of illumination and the plate. As the photopolymerizable system is most sensitive to shorter wavelength light, an UV light source is preferred.

In case of digital exposure, a light-emitting device, such as a laser, scans the film in raster fashion corresponding to digitized data describing the electronically available image.

In both instances, illumination of the photopolymerizable film must be sufficiently intense so as to bring about a sufficient degree of polymerization in exposed areas and provide the required difference in conductivity between exposed and non-exposed areas.

Charging

The usual means of charging the xeroprinting plate is by means of simple corona discharge or a more complex charging unit such as a scorotron for example.

Development

Latent images can be developed by means of liquid developers, consisting of a colloidal system of charged colloidal particles in an insulating liquid. In the conventional photocopying process the use of liquid developers is rather seldom. In the xeroprinting process liquid developing systems still are used, in particular in view of the high resolution attainable with such developing system. The latent image of the xeroprinting process can also be developed with a finely divided dry developing material of toner to form a powder image which is subsequently transferred onto a support sheet such as paper.

The most widely used dry development technique nowadays is by means of magnetic brush either monocomponent or two-component, the latter being more suited for colour applications as colourless and transparent magnetic pigments, to be used in full-colour monocomponent toner, are not obvious.

The magnetic brush development technique involves the use of magnetic toner (monocomponent) or of magnetic means associated with a developing mixture composed of magnetic carrier particles carrying a number of smaller electrostatically adhering toner particles (two-component). In this technique the developer composition is maintained during the development cycle in a loose, brushlike orientation by a magnetic field surrounding, for example, a rotatable non-magnetic cylinder having a means with magnetic poles mounted inside. In the two-component system the magnetic carrier particles are attracted to the cylinder by the described magnetic field, and the toner particles are held to the carrier particles by virtue of their opposite electrostatic polarity. Before and during development, the toner acquires an electrostatic charge of a sign opposite to that of the carrier material due to triboelectric charging derived from their mutual frictional interaction. This brushlike mass of magnetic carrier with adhering toner particles is thereupon drawn across the surface bearing the electrostatic image.

As is described in R. M. Schaffert, cited above, p. 50–51, two alternative ways of reversal development of latent electrostatic images can be applied.

According to the most common technique of application of reversal development, an electrostatic latent image is reversal developed by applying a development electrode. Under these conditions, and assuming an initially positively charged electrostatic image has been formed, negative charges will be induced in the master plate surface so that the positive charges in the area of greatest original charge density are nearly neutralised, a net negative value is maintained to act as a cleaning field in order to prevent background deposition of toner and residual negative charges remain in the other areas.

After this procedure, which has resulted in a complete reversal of the electrostatic image, which has now been transformed into a negatively-charged image, development with a positively charged toner completes the process of reversal development.

Transfer and Fusing

When the electrostatic image has been developed, transfer from the plate to paper or another substrate should take place. The toner image may be transferred to any suitable substrate such as paper, polymeric film, cloth or an integrated circuit board. In the latter case the xeroprinting process can be employed for either putting conductive circuit lines on an insulating board or for putting a non-conductive circuit pattern, e.g. consisting of a resist material, to an insulating board covered with a conductor. The xeroprinting process according to the invention can also be used for making color proofs, either by the color overlay method or by making a color surprint proof. In this case four masters corresponding to four separation negatives (cyan, magenta, yellow and black) of an original are prepared and each is charged and toned with the corresponding process color toner. For the production of an overlay, each toner image is transferred to a separate transparent material, such as a polyethylene terephthalate film whereas for the production of a surprint, the four toner images are sequentially transferred to the same sheet.

The transfer to the substrate such as paper may be accomplished by using adhesive-coated paper or by electrical attraction, the latter being the most common technique.

The paper is placed in contact with the image side of the plate whereby the paper is electrically charged with the polarity opposite to that of the toner image. The charge applied to the paper overcomes the attraction of the imaging layer for the toner particles and pulls them onto the paper (this technique is often referred to as the bias technique). After stripping the paper from the plate, the support sheet bearing the toner powder image is passed through a fusing apparatus.

There are different types of fusing processes used for fusing a toner powder image to its support. Some are based primarily on fusing by heat, other are based on softening by solvent vapours, or by the application of cold flow at high pressure in ambient conditions of temperature. In the fusing processes based on heat, five major types should be considered. The first is an oven heating process in which heat is applied by hot air over a wide portion of the support sheet, the second is a flash heating process in which heat is produced in the toner by absorption of light energy emitted by a flash lamp, the third is a radiation process wherein the support with the toner image is irradiated mainly by infrared-radiation, and the fourth is a heating process wherein the support with the toner image is simultaneously pressed and heated. The latter process is commonly called the heated roller fusing process. Another, fifth type, is based on heat conduction from a heated member through the substrate of the toner image, towards the top toner layer (commonly called back-side fusing).

In a common heat- and pressure fusing process the support carrying the non-fixed toner image is conveyed through the nip formed by a heating roller also called fuser roller and another roller backing the support and functioning as pressure exerting roller, called pressure roller. This roller may be heated to some extent so as to avoid strong heat loss within the copy.

The last mentioned fusing process has been employed widely in low-speed as well as high-speed fusing systems, since a remarkably high thermal efficiency is obtained because the surface of the heating roller is pressed against the toner image surface of the sheet to be fixed. An additional advantage is the possibility to use colour-toners, since the energy absorption is independent of the wavelength. Moreover this fusing process allows double-sided copying, or so-called duplex printing. The heated roller fusing process is recommended for putting the present invention into practical use, in particular when applications such as color reproduction and higher volume printing work are envisaged.

Photopolymerizable Printing Plate

Photopolymerizable electrostatic master plates comprise an electrically conductive substrate, e.g. aluminized polyethylene terephtalate, whereupon a layer of photohardenable composition has been coated. The latter layer generally is made up of an organic polymeric binder, a monomer compound, polymerizable upon exposure to actinic radiation, a photoinitiator, sensitizers, stabilizers, as well as various other additives.

Examples of photohardenable compositions suitable for use according to the present invention are described in the Article of E. Inoue and H. Fukutomi, cited above, as well as in the already cited EU-A-0279960. Suitable examples of photoinitiators are e.g. free-radical producing oxime esters such as are disclosed in U.S. Pat. No. 3,558,309 of U. L. Laridon and G. A. Delzenne, issued Jan. 26, 1971.

A protective coversheet is preferably laminated to the photopolymer surface.

Developers

Various kinds of liquid and dry developers may be used according to the present invention. Liquid developers have in general the advantage that the highest resolution attainable is considerable higher than with conventional dry developers, thanks to the very small particle size of the toner particles dispersed. However, it entails much inconvenience to the customer caused by the required evaporation of the developer solvent.

Suitable examples of liquid developers are described e.g. in UK Patent No. 1576719 or EU-A-0215978. Suitable examples of one and two-component dry developers are described in EU-A-0279960. When high resolution printing applications are envisaged it is recommended to use very fine toner particles, corresponding to a well-defined particle size distribution. Examples of such toner compositions are disclosed in e.g. UK 2180948, EU-A-0255716, U.S. Pat. No. 4,737,433, and 85 JP-192711.

The invention is illustrated hereinafter by way of an example. However, the invention is neither limited to the described example, nor to the embodiments illustrated therein.

EXAMPLE

Photopolymerizable Plate

A polyethylene terephthalate substrate having a thickness of 165 micron with having a vacuum-coated aluminum layer of 100 nm was coated with a solution containing 90 parts of a solvent mixture of methylene chloride methanol 90/10 and 10 parts of a photohardenable system according to the following composition so as to yield 20 g of the photohardenable composition per square meter.

| ingredient | chemical compound | g/m2 | % |
|---|---|---|---|
| binder | cellulosetriacetate | 11 | 55 |
| initiator | ketoximeester according to the following formula: 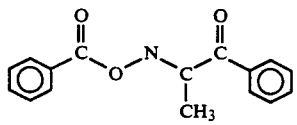 | 0.79 | 3.94 |
| sensitizer | 1-ethyl-3-phenyl-7-dimethylamino-2-chinolon | 0.79 | 3.94 |
| stabilizer | 2,6-di.t.butyl p-cresol | 0.024 | 0.12 |
| monomer | pentaerythritol tetraacrylate | 7.4 | 37 |

The third column indicates the amount of each of the ingredients in the photohardenable composition after coating and evaporation of the solvent (dry state).

The fourth column indicates the same values expressed in weight percentage figures of the total composition.

An aqueous solution of the ammonium salt of p-co(vinylacetate-crotonic acid 90/10) was laminated to the coating of photohardenable composition so as to yield a cover sheet of 1 to 2 microns (dry state). This protective cover sheet should not be separated from the photopolymer layer either before exposure or thereafter.

Toner Preparation 90 parts of ATLAC T500 (trade name of Atlas Chemical Industries Inc., Wilmington, Del., USA) being a propoxylated bisphenol A fumarate polyester with a glass transition temperature of 51° C., a melting point in the range of 65° C. to 85° C., an acid number of 13.9, and an intrinsic viscosity measured at 25° C. in a mixture of phenol-ortho dichlorobenzene (60/40 by weight) of 0.175, 10 parts of Cabot Regal 400 (trade name of Cabot Corp., Boston, Mass., USA) being a carbon black, were introduced in a kneader. In order to improve the chargeability of the toner particles BONTRON S36 (trade name of Oriental Chemical Industries—Japan) being a metal complex dye, was added as negative charge polarity offering charge control agent in an amount of 5% by weight. The mixture was then heated at 120° C. to form a melt; upon which the kneading process was started. After about 30 minutes, the kneading was stopped and the mixture was allowed to cool to room temperature (20° C.). At that temperature the mixture was crushed and milled to form a powder.

Suitable milling and air classification results may be obtained when employing an apparatus such as the A.F.G. (Alpine Fliessbeth-Gegenstrahlmühle) type 100 as milling means, equipped with an A.T.P. (Alpine Turboplex Windsichter) type 50 GS, as air classification means. Further air classification can be obtained using an Alpine Multiplex Labor Zich-zachsichter, type 100 MZR as additional classification apparatus. All models are available from the Alpine Process Technology. The settings for these apparatus were as follows: A.T.P. 50, 10000 rpm, 5.5 bar, nozzles 3×1.9 mm; 100 MZR: 15000 rpm, 52 $m^3/h$.

Hereupon, the toner particles were introduced in a mixing apparatus, Aerosil R812 (a trade name of Degussa Ag, Germany) being a fumed silica with a specific surface of 250 $m^2/g$ and an average particle diameter of 7 nm, the surface being hydrophobic, was admixed to the toner, and said mixture was then intensively shaken for about 30 minutes to enhance its flowability. The concentration by weight of fumed silica with respect to toner was 0.5.

The average diameter of the toner particles so prepared was 5.11 microns by volume and 4.10 microns by number, as determined in a Coulter Counter measuring apparatus.

Developer Preparation

A magnetic brush developer was obtained by mixing the obtained toner with a typical carrier such as a ferrite carrier (Ni-Zn type) with a magnetization of 50 EMU/g. The average carrier particle diameter was about 65 um.

The concentration of toner in percentage to the carrier weight was on or about 2.5%.

PROCESS

1. Exposure

A photopolymer contact printing plate prepared according to the procedure aforementioned was exposed in contact with a negative transparent film in a PRINTON CDL 1501 contact exposure unit, marketed by Agfa-Gevaert N.V., Mortsel, Belgium. The 1000 W metal halogen light source of said exposure unit was set at level 2 corresponding with a light intensity of 1500 uW/sq. cm, and the film was exposed during 1000 exposure units, corresponding with 100 sec of illumination, or 150 $mJ/cm^2$ per 100 sec. Hereupon the photopolymer plate was introduced in an apparatus, the construction of which was based upon AGFA's X-35 xerocopying apparatus, being a copier marketed by Agfa-Gevaert N.V., Mortsel, Belgium, but which apparatus was so modified so as to suit the charging, subsequent reversal development of said photopolymer plate and the transfer and subsequent fusing of the developed toner image to a substrate such as e.g. paper. This modified xeroprinting apparatus had the characteristics as described hereinafter. The result was a positive print.

2. Charging

The photopolymer plate was negatively charged to −700 V using a single wire corona set at −3.5 kV equipped with a grid set at −700 V; the plate was mounted on a drum with a diameter of 15 cm and was moving at a process speed of 10 cm/sec. The voltage on both exposed and unexposed areas of the plate was measured with an electrostatic voltmeter, which yielded the following results.

| | (a) | | (b) | |
|---|---|---|---|---|
| | (1) | (2) | (1) | (2) |
| voltage | −580 V | −25 V | −195 V | 0 V |

(a) 1.5 second after end of charging
(b) 10 seconds after end of charging
(1) represents voltage in exposed areas
(2) represents voltage in unexposed areas

3. Development

The electrostatic image formed on the xeroprinting plate was then developed by a magnetic brush which was built up with the developer containing negatively charged toner particles as described hereinabove. Reversal development was executed by using a voltage controlled development electrode which applied a bias potential of −350 V to the development unit. Hereby toner particles deposited to the initially non-charge carrying, i.e. unexposed, areas and hence a direct-positive toned image was formed on the photopolymer plate.

4. Transfer

The transfer of the deposited toner image to a paper substrate proceeded by applying a positive voltage of +3 kV to a metal roll, which was kept in close ohmic contact with the rear side of the paper sheet acting as receiving material whose front side was therefore kept in close contact with the toner image on the xeroprinting plate.

5. Fusing

The image-wise transferred toner particles were fed to a radiation fusing device operating with an infrared light fusing element such as described in the text of Example 8 of U.S. Pat. No. 4,525,445.

6. Cleaning, Regeneration

After transfer of the toner image to the substrate the xeroprinting plate was cleaned from residual toner particles with conventional means, i.e. polyurethane scraper doctor blade, and electrically reset to zero by using a conventional alternating current single wire corona.

7. Printing

Repetitive runs up to 1000 prints were made without noticeable quality decrease.

We claim:

1. A xeroprinting process comprising the following steps:
   (a) image-wise exposing to actinic radiation an electrostatic master having a photopolymerizable conductive layer to selectively polymerize and thereby increase resistivity in exposed areas of the layer;
   (b) forming a latent image of electrostatic charge by charging the master by corona discharge;
   (c) developing the latent image by depositing toner particles having the same charge as the polarity of the corona-charging in the non-exposed areas of said layer facing a development electrode biased in such a way that reversal development takes place;
   (d) transferring the toner image to another substrate and subsequent fusing;
   (e) resetting the process by cleaning and discharging the electrostatic master.

2. Xeroprinting process according to claim 1, wherein the reversal development of the electrostatic latent image is effected by means of a development electrode thereby inducing charges in the photopolymer plate opposite to the initial electrostatic image.

3. Xeroprinting process according to claim 1 wherein the development is effected by dry electrophotographic developer.

4. Xeroprinting process according to claim 1 wherein the development is effected by liquid electrophotographic developer.

5. Xeroprinting process according to claim 1 wherein the photopolymerizable layer consists essentially of a polymeric binder, a monomer compound polymerizable upon exposure to actinic radiation, a sensitizer, a photoinitiator, and a stabilizer.

6. Xeroprinting process according to claim 5 wherein the binder is cellulosetriacetate, the initiator is a ketoximeester, the sensitizer is 1-ethyl-3-phenyl-7-dimethylamino-2-chinolon, the stabilizer is 2,6-di-t-butyl p-cresol and the monomer is pentaerythritol tetraacrylate.

7. Xeroprinting process according to claim 6 wherein the ketoxime ester is a compound according to the following formula:

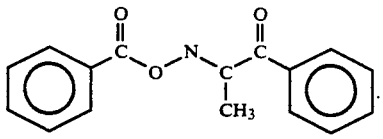

8. Xeroprinting process according to claim 5 wherein the photopolymerizable layer is coated with a protective layer.

9. Xeroprinting process according to claim 8 wherein the protective layer comprises essentially p-co(vinylacetate-crotonic acid).

10. Xeroprinting process according to claim 1 wherein the illumination of the photopolymerizable conductive layer is effected through a process-color separation halftone negative, and the toner images are transferred to a transparent polymeric film or paper to provide a 4-color overlay or surprint color proof.

* * * * *